US006669235B2

(12) United States Patent
Vijuk et al.

(10) Patent No.: US 6,669,235 B2
(45) **Date of Patent: *Dec. 30, 2003**

(54) METHODS OF FORMING INFORMATIONAL ITEMS

(75) Inventors: Joseph M. Vijuk, 403 Royal Glen Ct., Oak Brook, IL (US) 60521; Robert Vijuk, Downers Grove, IL (US)

(73) Assignee: Joseph M. Vijuk, Elmhurst, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/041,197

(22) Filed: Jan. 8, 2002

(65) Prior Publication Data

US 2002/0056987 A1 May 16, 2002

Related U.S. Application Data

(63) Continuation of application No. 09/697,070, filed on Oct. 26, 2000, now Pat. No. 6,349,973, which is a continuation of application No. 09/470,374, filed on Dec. 22, 1999, now Pat. No. 6,158,778, which is a continuation of application No. 09/305,966, filed on May 6, 1999, now Pat. No. 6,068,300, which is a continuation of application No. 09/031,191, filed on Feb. 26, 1998, now Pat. No. 5,909,899, which is a continuation of application No. 08/492,213, filed on Jun. 19, 1995, now Pat. No. 5,813,700, which is a continuation-in-part of application No. 08/324,350, filed on Oct. 17, 1994, now abandoned, which is a continuation-in-part of application No. 08/264,181, filed on Jun. 22, 1994, now Pat. No. 5,458,374, which is a continuation of application No. 08/037,294, filed on Mar. 26, 1993, now abandoned.

(51) Int. Cl.[7] ..... B42D 15/00

(52) U.S. Cl. ..... 283/67; 40/539; 281/2; 283/34; 283/61; 283/106; 428/121; 428/130; 493/395; 493/405; D20/21; D20/22

(58) Field of Search ..... 283/61, 62, 63, 283/67, 81, 34, 106; 281/2, 5; D20/21, 22; 428/40.1, 130, 121, 124; 40/539; 493/356, 395, 405, 409

(56) References Cited

U.S. PATENT DOCUMENTS 1,239,965 A 9/1917 Reinhold (List continued on next page.)

FOREIGN PATENT DOCUMENTS

DE 10939 9/1880

(List continued on next page.)

*Primary Examiner*—Monica Carter
(74) *Attorney, Agent, or Firm*—Marshall, Gerstein & Borun LLP

(57) ABSTRACT

A method of producing a folded item having printed information thereon to provide information to the user of a product is disclosed. The method comprises (a) forming a first article having a first end, a second end, a length along a first direction, and a width along a second direction perpendicular to the first direction, the first article having a plurality of first elongate sheet portions and a plurality of second elongate sheet portions, each of the first elongate sheet portions having a first end and a second end, and each of the second elongate sheet portions having a first end and a second end, each of the first ends of the first elongate sheet portions being joined to a respective one of the first ends of the second elongate sheet portions at a respective fold coinciding with the first end of the first article so that the first end of the first article has no exterior unfolded sheet edges, each of the respective folds being parallel to the second direction; (b) folding the first article by making a first transverse fold in the first article to form a second article, the first transverse fold being parallel to the second direction and being made so that the second end of the first article is disposed between the first end of the first article and the first transverse fold; (c) depositing an adhesive on a portion of the second article; and (d) folding the second article by making a second transverse fold in the second article to form the folded item, the second transverse fold being parallel to the second direction so that the folded item has no exterior unfolded sheet edges which lie in a direction parallel to the second direction, the thickness of the sheet being such that when the folds in the first and second directions are made, the folds will cause the folded item to have a thickness of 0.25 inches or greater.

12 Claims, 10 Drawing Sheets

U.S. PATENT DOCUMENTS

| | | | | |
|---|---|---|---|---|
| 1,326,859 | A | 12/1919 | Grammar | |
| 1,853,829 | A | 4/1932 | Maury | 283/34 |
| 2,114,130 | A | 4/1938 | Brate | 229/92.1 |
| 2,179,172 | A | 11/1939 | Bonnaire | 283/62 |
| 2,751,222 | A | 6/1956 | Dexter | 270/81 |
| 2,862,624 | A | 12/1958 | Stokes | 281/21.1 X |
| 3,760,520 | A | 9/1973 | Hamilton | 40/102 |
| 3,773,314 | A | 11/1973 | Giovannini | 270/63 |
| 4,010,299 | A | 3/1977 | Hershey, Jr. et al. | 40/310 X |
| 4,046,366 | A | 9/1977 | McCain et al. | 270/21 |
| 4,097,067 | A | 6/1978 | Schechter | 283/62 X |
| 4,229,926 | A | 10/1980 | Rowling | 53/429 |
| 4,270,742 | A | 6/1981 | Kobayashi | 270/37 |
| 4,279,409 | A | 7/1981 | Pemberton | 270/32 |
| RE30,958 | E | 6/1982 | White | 40/310 |
| 4,583,763 | A | 4/1986 | Shacklett, Jr. | 281/2 X |
| 4,606,553 | A | 8/1986 | Nickerson | 281/5 |
| 4,616,815 | A | 10/1986 | Vijuk | 270/45 |
| 4,637,633 | A | 1/1987 | Instance | 283/81 |
| 4,660,856 | A | 4/1987 | Shacklett, Jr. | 281/5 |
| 4,812,195 | A | 3/1989 | Vijuk | 156/357 |
| 4,817,931 | A | 4/1989 | Vijuk | 270/18 |
| 4,850,611 | A | 7/1989 | Skelton | 251/5 |
| 4,887,373 | A | 12/1989 | Macaulay | 40/119 |
| 4,905,977 | A | 3/1990 | Vijuk | 270/45 |
| 4,906,024 | A | 3/1990 | Lein | 283/34 X |
| 4,997,205 | A | 3/1991 | Hansch | 281/2 |
| 5,044,873 | A | 9/1991 | Vijuk | 414/712.5 |
| 5,046,710 | A | 9/1991 | Vijuk | 270/37 |
| 5,156,898 | A | 10/1992 | McDonald | 428/130 X |
| 5,234,231 | A | 8/1993 | Hollander et al. | 281/2 |
| 5,234,735 | A | 8/1993 | Baker et al. | 428/40 |
| 5,351,991 | A | 10/1994 | McDonald | 281/5 X |
| 5,458,374 | A | 10/1995 | Vijuk et al. | 281/2 X |
| 5,655,866 | A | 8/1997 | Bellanca | 412/1 |
| 5,667,210 | A | 9/1997 | DeLise, Jr. | 270/37 |
| 5,685,530 | A | 11/1997 | DeLise | 270/37 |
| 5,813,700 | A | 9/1998 | Vijuk et al. | 283/81 |
| 5,909,899 | A | 6/1999 | Vijuk et al. | 283/81 |
| 6,029,968 | A | 2/2000 | Honegger | 270/37 |
| 6,068,300 | A | 5/2000 | Vijuk et al. | 283/67 |
| 6,158,778 | A | 12/2000 | Vijuk et al. | 283/67 |
| 6,349,973 | B1 | 2/2002 | Vijuk et al. | 283/67 |
| 6,363,851 | B1 * | 4/2002 | Gerhard et al. | 101/483 |

FOREIGN PATENT DOCUMENTS

| | | |
|---|---|---|
| DE | 31 25 369 | 6/1981 |
| DE | 93 08 759 | 9/1993 |
| DE | 93 08 760 | 9/1993 |
| DE | 198 18 160 | 10/1999 |
| FR | 744196 | 4/1933 |
| FR | 1403865 | 5/1965 |
| GB | 28013 | of 1907 |
| GB | 20385 | of 1914 |
| GB | 1429868 | 5/1973 |

* cited by examiner

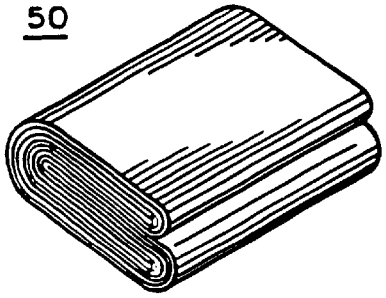
FIG. 4A
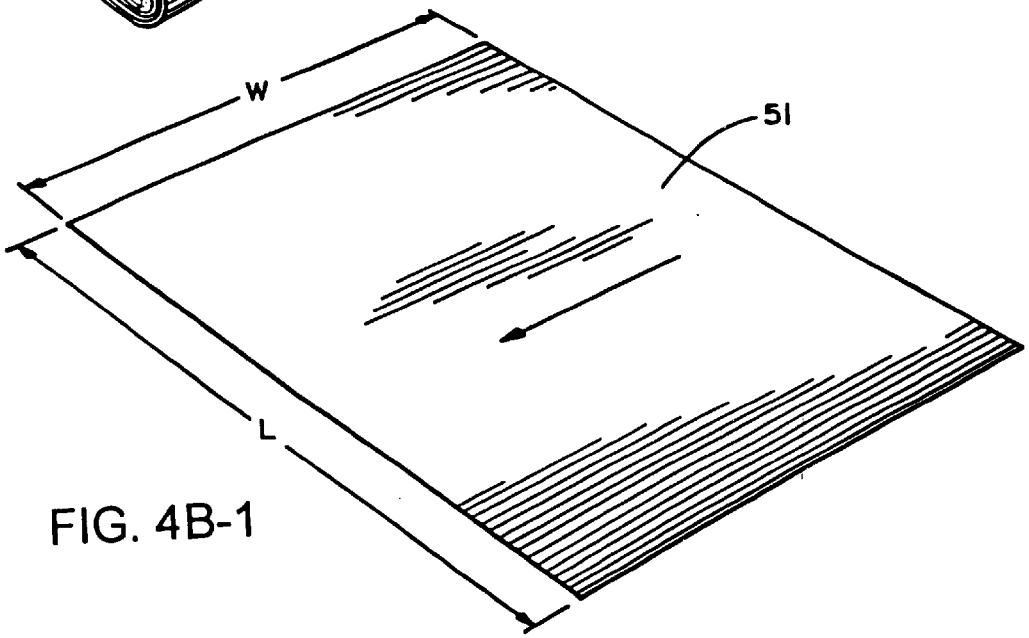
FIG. 4B-1
FIG. 4B-2
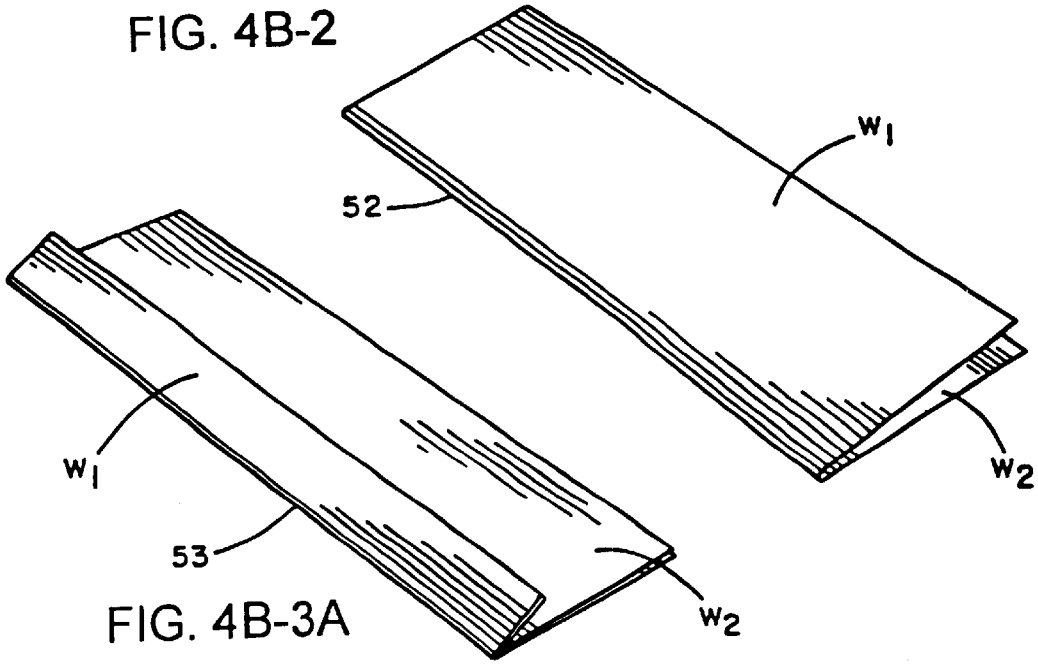
FIG. 4B-3A

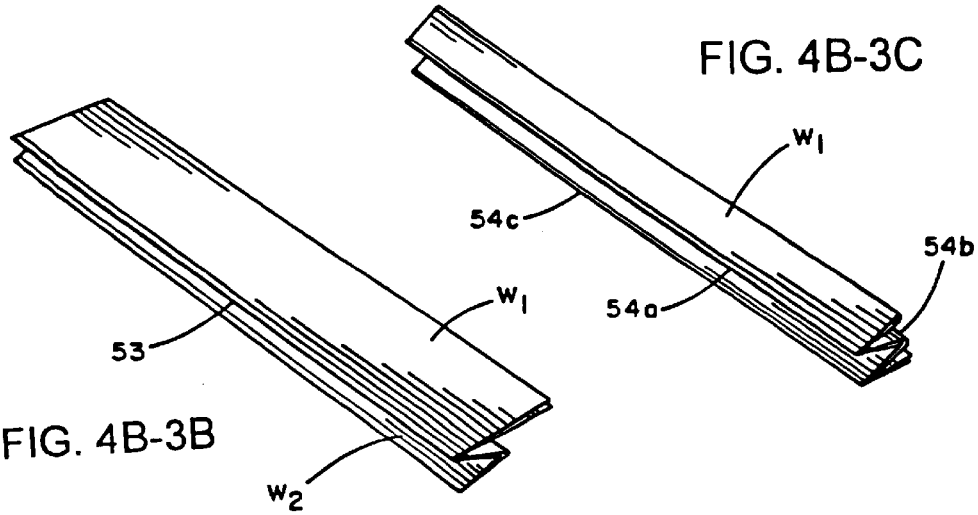
FIG. 4B-3C
FIG. 4B-3B
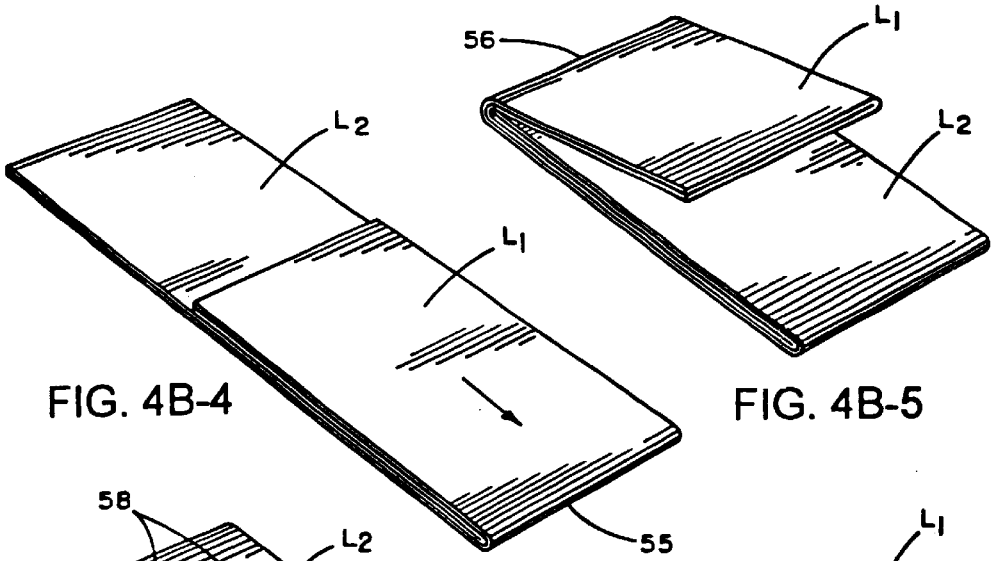
FIG. 4B-4
FIG. 4B-5
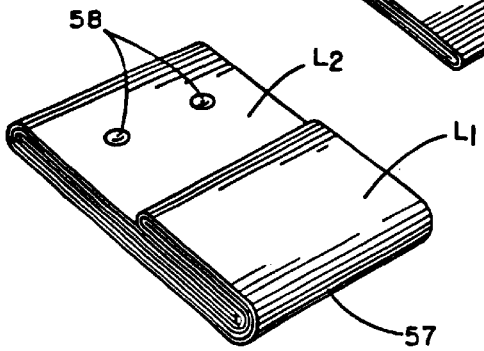
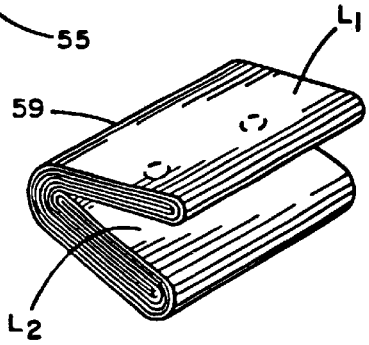
FIG. 4B-6
FIG. 4B-7

METHODS OF FORMING INFORMATIONAL ITEMS

This patent is a continuation of allowed U.S. Ser. No. 09/697,070 filed Oct. 26, 2000, now U.S. Pat. No. 6,349, 973, which is a continuation of U.S. Ser. No. 09/470,374 filed Dec. 22, 1999, now U.S. Pat. No. 6,158,778, which is a continuation of U.S. Ser. No. 09/305,966 filed May 6, 1999, now U.S. Pat. No. 6,068,300, which is a continuation of U.S. Ser. No. 09/031,191 filed Feb. 26, 1998, now U.S. Pat. No. 5,909,899, which is a continuation of U.S. Ser. No. 08/492,213 filed Jun. 19, 1995, now U.S. Pat. No. 5,813,700, which is a continuation-in-part of U.S. Ser. No. 08/324,350 filed Oct. 17, 1994, now abandoned, which is a continuation-in-part of U.S. Ser. No. 08/264,181 filed Jun. 22, 1994, now U.S. Pat. No. 5,458,374, which is a continuation of U.S. Ser. No. 08/037,294 filed Mar. 26, 1993, now abandoned, and a continuation-in-part of U.S. Ser. No. 08/264,181 filed Jun. 22, 1994, which is a continuation of U.S. Ser. No. 08/037, 294 filed Mar. 26, 1993. All of the patent applications and patents identified in this paragraph are incorporated by reference herein in their entirety.

BACKGROUND

This patent relates to methods of folding informational items which have printed information, such as instructions and/or warnings, relating to pharmaceutical products.

Informational items, such as outserts, are used to convey information to purchasers and users of pharmaceutical products. The information printed on an outsert typically includes instructions for use of a pharmaceutical product and medical warnings relating to the product. The outsert typically accompanies the product, such as by being affixed directly to the container in which the pharmaceutical product is provided or by being enclosed within a cardboard carton in which the pharmaceutical container is packaged.

A method of forming outserts is disclosed in U.S. Pat. No. 4,812,195 to Michael Vijuk. In that patent, outserts are manufactured by folding a relatively long sheet a number of times in a direction perpendicular to the length of the sheet and then cutting the folded sheet a number of times in a direction perpendicular to the folding direction to make a number of individual outserts. The result of the folding and cutting steps is a "ribbon" style outsert like the one shown in FIG. 1B.

FIG. 1A illustrates an example of an outsert 10 constructed in accordance with the prior art which has open edges 12 about its periphery. FIG. 1B illustrates a conventional ribbon style outsert 14 constructed in accordance with the prior art. The outsert 14 has a tail portion 16 which, prior to opening of the outsert by the purchaser of the associated pharmaceutical product, is glued to an interior portion of the outsert. The tail portion 16 consists of a single sheet having an unfolded, exterior sheet edge which lies in a direction parallel to the folding direction.

SUMMARY OF THE INVENTION

In one aspect, the invention is directed to a method of folding a sheet having printed information thereon to form an outsert for providing information to the user of a product. The method comprises (a) folding the sheet by making a first fold in the sheet, the first fold being parallel to a first direction; (b) folding the sheet by making a second fold in the sheet, the second fold being parallel to the first direction; (c) folding the sheet by making at least one additional fold in the sheet, the additional fold being parallel to the first direction and being made to form a first folded article having a first end and a second end, each of the first and second ends of the first folded article having unfolded exterior sheet edges which lie in a direction perpendicular to the first direction; (d) after completion of (a) through (c), folding the first folded article by making a first fold in the first folded article in a second direction perpendicular to the first direction to form a second folded article, the second folded article having a first end and a second end, the first end of the second folded article having no unfolded exterior sheet edges; (e) making at least one additional fold in a direction parallel to the second direction to form a third folded article, the third folded article having a sheet portion; (f) depositing an adhesive on the sheet portion of the third folded article; and (g) folding the third folded article by making a final fold in a direction parallel to the second direction to form the outsert, the final fold being made so that the second end of the second folded article is covered by one of the sheet portions of the outsert and so that there are no unfolded exterior sheet edges which lie in a direction parallel to the second direction, the thickness of the sheet being such that when the folds in the first and second directions are made, the folds will cause the outsert to have a thickness of 0.25 inches or greater.

In another aspect, the invention is directed to a method of producing a folded item having printed information thereon to provide information to the user of a product. The method comprises (a) forming a first article having a first end, a second end, a length along a first direction, and a width along a second direction perpendicular to the first direction, the first article having a plurality of first elongate sheet portions and a plurality of second elongate sheet portions, each of the first elongate sheet portions having a first end and a second end, and each of the second elongate sheet portions having a first end and a second end, each of the first ends of the first elongate sheet portions being joined to a respective one of the first ends of the second elongate sheet portions at a respective fold coinciding with the first end of the first article so that the first end of the first article has no exterior unfolded sheet edges, each of the respective folds being parallel to the second direction; (b) folding the first article by making a first transverse fold in the first article to form a second article, the first transverse fold being parallel to the second direction and being made so that the second end of the first article is disposed between the first end of the first article and the first transverse fold; (c) depositing an adhesive on a portion of the second article; and (d) folding the second article by making a second transverse fold in the second article to form the folded item, the second transverse fold being parallel to the second direction so that the folded item has no exterior unfolded sheet edges which lie in a direction parallel to the second direction, the thickness of the sheet being such that when the folds in the first and second directions are made, the folds will cause the folded item to have a thickness of 0.25 inches or greater.

BRIEF DESCRIPTION OF THE DRAWINGS

FIGS. 3B-1 through 3B-6 illustrate the method of forming the outsert illustrated in FIG. 3A;

FIG. 4A is a perspective view of a third embodiment of an outsert;

FIGS. 4B-1 through 4B-7 illustrate the method of forming the outsert illustrated in FIG. 4A;

FIG. 5 is a perspective view of an outsert applied to the outside of a container for a pharmaceutical product;

FIGS. 6B-1 through 6B-10 illustrate the method of forming the outsert illustrated in FIG. 6A;

FIGS. 7B-1 through 7B-10 illustrate the method of forming the outsert illustrated in FIG. 7A; and FIG. 8 is a perspective view of an outsert applied to the top of a container for a pharmaceutical product.

DETAILED DESCRIPTION OF THE PREFERRED EMBODIMENTS

Figure 2A:
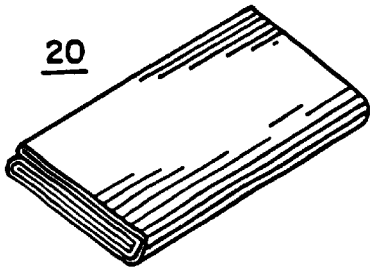
FIG. 2A is a perspective view of a first embodiment of an outsert.
Figures 1, 2B:
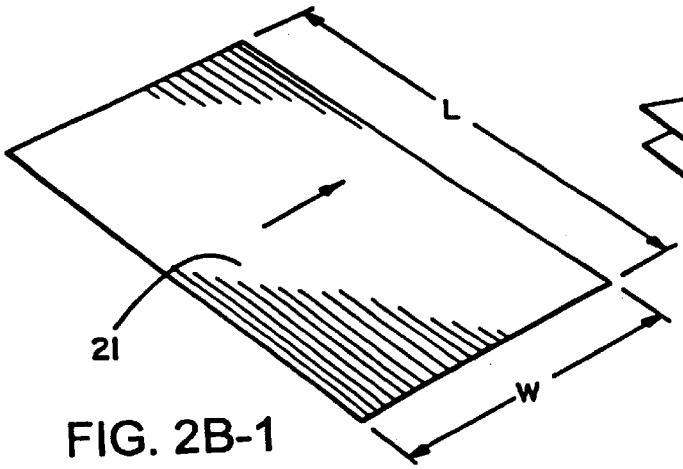

FIG. 2A is a perspective view of a universal, nonjamming, multi-ply outsert 20 having multiple folds, which is manufactured from an integral sheet of stock. FIGS. 2B1-1 through 2B-5 illustrate the method of forming the outsert 20 depicted in FIG. 2A. Referring to FIGS. 2A and 2B, the method starts with web stock that is directly fed to an in-line cutter, where the stock is cut into separate individual sheets (or, alternatively, starting with individual sheet stock which is automatically stacked and fed). The size of the individual sheet stock is variable. For example, it has been demonstrated that starting with a commercial grade sheet stock having an overall length (L) of approximately 8.375 inches, and an overall width (W) of approximately 4.125 inches, an outsert can be manufactured having a total of four folds, twelve total ply thickness, and an overall size of approximately 2.438 inches wide, approximately 1.5 inches high, and approximately 0.125 inches thick (depending on the thickness of the individual sheet stock used).

Figures 2, 2B:
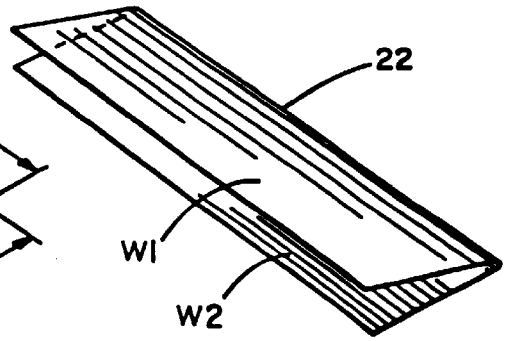

To manufacture the outsert depicted in FIG. 2A, starting at FIG. 2B-1, and with the individual sheet stock 21 traveling in a predetermined first direction, an initial fold 22 is made across the entire length of the sheet stock and is at a right angle from the point of origin (see FIG. 2B-2). This initial fold may be an even fold or an uneven fold (i.e., may be folded over to less than all of the adjoining section of sheet stock). This initial fold results in the sheet stock having a top panel (W1) and an adjoining bottom panel (W2). If the initial fold is an even fold, the resulting width will be ½ of the initial width (i.e., W1=W2=½ W). Following completion of this initial fold, the sheet stock will have an overall thickness of two plies.

Figures 2, 2B, 3:
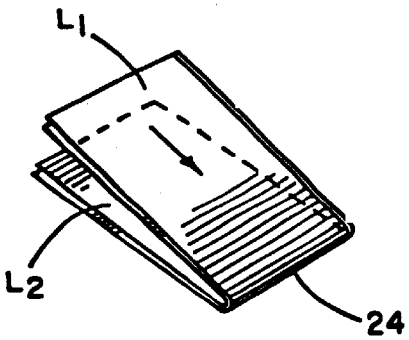

At FIG. 2B-3, and following the re-orientation of the individual sheet stock 21 to a different predetermined second direction (i.e., re-oriented substantially 90 degrees from the first direction), a second fold 24 is then made across the entire width of the sheet stock at a designated location and is at a right angle from the point of origin. This second fold may be an even fold or an uneven fold (i.e., may be folded over to less than all of the adjoining section of the sheet stock). This second fold will result in the sheet stock having a top panel length (L1) and an adjoining bottom panel length (L2).

If the second fold is an even fold, the resulting length will be ½ of the initial length (i.e., L1=L2=½ L). Following completion of this second fold, the sheet stock will have an overall thickness of four plies. Also, after completion of this second fold, the resulting folded sheet stock will have two ends of orientation, one end being a folded closed-end, and the other end being an open-edge end, not having any fold.

At FIG. 2B-4, a third fold 26 is made across the entire width of the sheet stock at a right angle from the point of origin, the third fold being located at the open-edge end of the folded sheet stock. This third fold is equal to approximately ⅓ of the total panel length and will result in the sheet stock now having a resulting top panel length (L1) and a resulting adjoining bottom panel length (L2) (i.e., L1=⅓ L and L2=⅔ L). Following completion of this third fold, the sheet stock will have an overall thickness of eight plies for the resulting top panel length, and four plies for the resulting bottom panel length.

Following the third fold (see FIG. 2B-4), at a designated location on the resulting top panel length, a single glue spot 25 (or glue spots) is made thereon, with a suitable adhesive. If desired, the gluing step may be omitted.

At FIG. 2B-5, a fourth fold 28 is made to complete the outsert. The fourth fold is made across the entire width of the sheet stock at a right angle from the point of origin, the fourth fold being located at the closed-end of the folded sheet stock. This fourth fold is equal to approximately ½ of the total panel length and will result in the sheet stock now having a resulting top panel length (L1) and a resulting adjoining bottom panel length (L2) (i.e., L1=½ L and L2=½ L). This fourth fold is made in a manner whereby the adhesive will maintain the outsert in a more or less fixed and compact relationship with respect to the top and bottom panel lengths of the folded sheet stock. Following completion of this final fold, the outsert will have an overall thickness of twelve plies.

Figures 2, 2B, 3, 4:
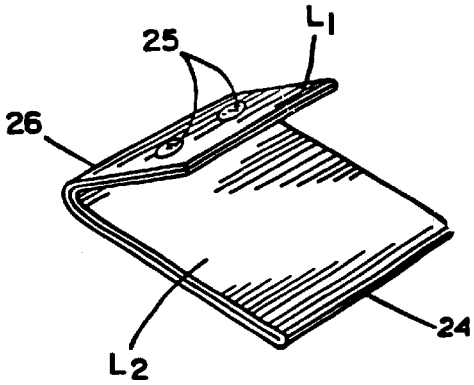
Figures 2, 2B, 3, 4, 5:
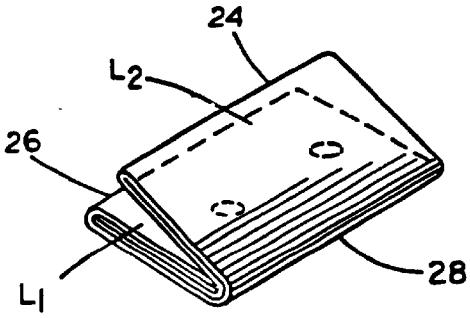
Figure 3A:
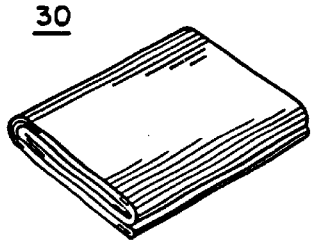
FIG. 3A is a perspective view of a second embodiment of an outsert.
Figures 1, 3B:
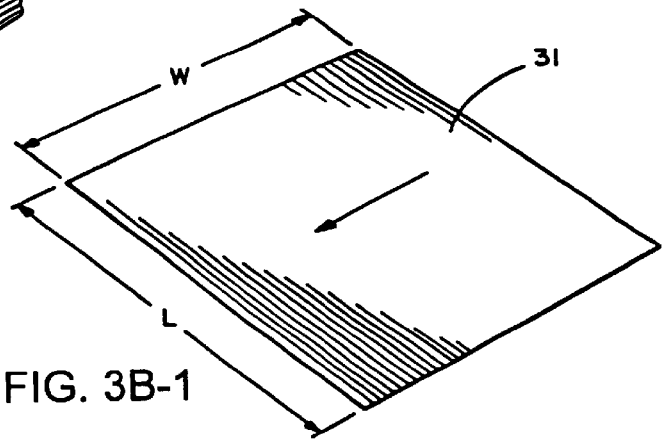
Figures 2A, 3B:
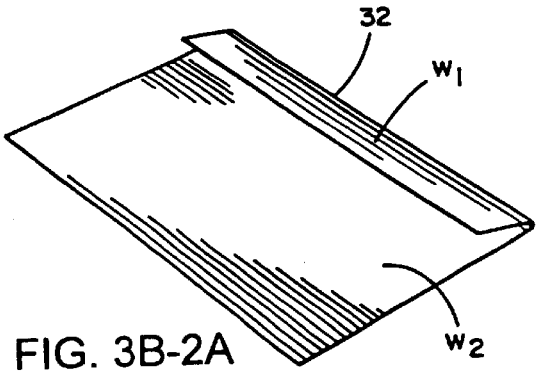
Figures 2C, 3B:
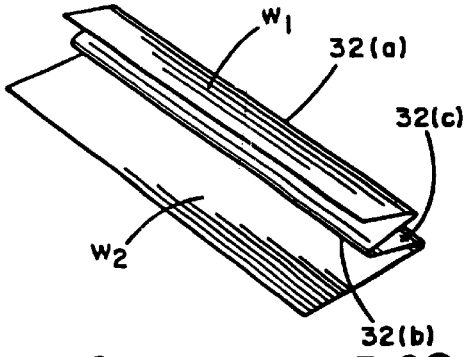
Figures 2B, 3B:
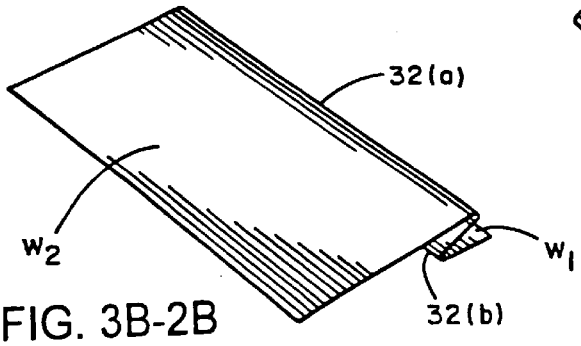

FIG. 3A is a perspective view of a universal, nonjamming, multi-ply outsert 30 having multiple folds, which is manufactured from an integral sheet of stock. FIGS. 3B-1 through 3B-6 illustrate the method of forming the outsert 30 depicted in FIG. 3A. Referring to FIGS. 3A and 3B, the method starts with web stock that is fed to an in-line cutter, where the stock is cut into separate individual sheets (or, alternatively, starting with individual sheet stock which is automatically stacked and fed). The size of the individual sheet stock is variable. For example, it has been demonstrated that starting with a commercial grade sheet stock having an overall length (L) of approximately 12 inches, and an overall width (W) of approximately 11 inches, an outsert can be manufactured having a total of eight folds, forty total ply thickness, and an overall size of approximately 2.25 inches wide, approximately 1.5 inches high, and approximately 0.3125 inches thick (depending on the thickness of the individual sheet stock used).

Figures 2D, 3B:
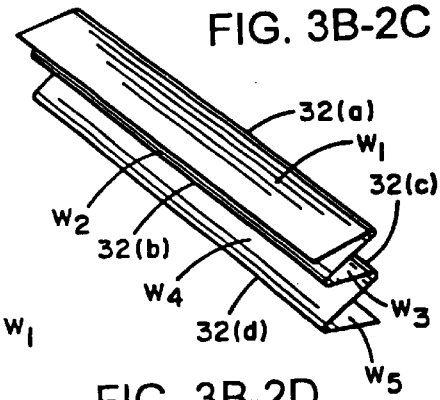
Figures 3, 3B:
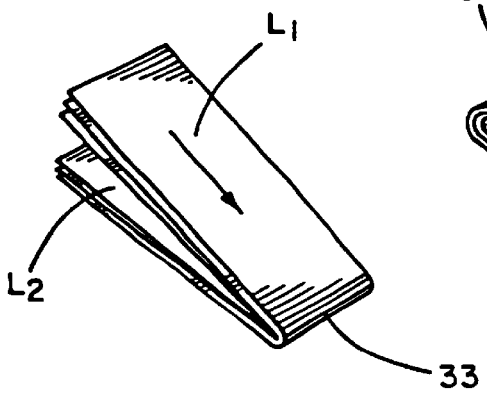
Figures 3, 3B, 4:
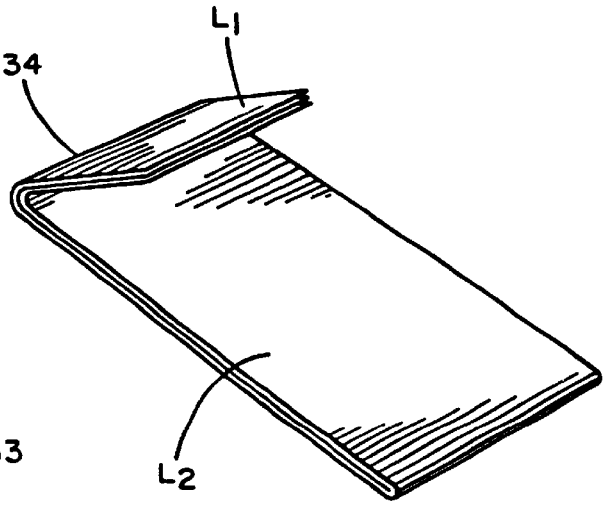
Figures 3, 3B, 4, 5:
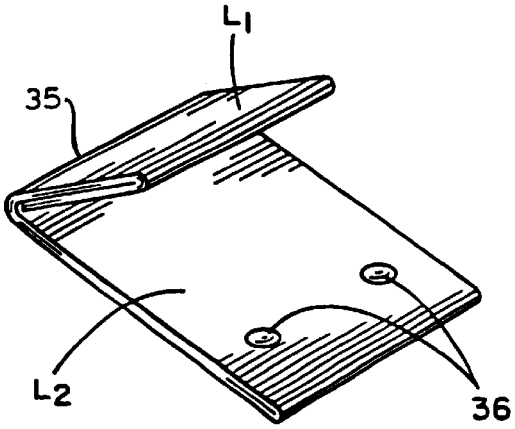

To manufacture the outsert depicted in FIG. 3A, starting at FIG. 3B-1, and with the individual sheet stock 31 traveling in a predetermined first direction, an initial fold 32, which consists of a number of substantially parallel folds (consisting of a series of tandem folds 32(*a*), 32(*b*), 32(*c*) and 32(*d*) comprising a four-fold accordion fold), is made across the entire length of the sheet stock and is at a right angle from the point of origin (see FIGS. 3B-2A through 3B-2D). This initial fold 32 may be an even fold or an uneven fold (i.e., may be folded over to less than all of the adjoining section of sheet stock).

If the initial fold 32 is an even fold, the resulting width will be ⅕ of the initial width (i.e., W1=W2=W3=W4=W5=

⅕ W). This initial fold is a four-fold tandem accordion fold and, assuming the initial fold has equal panels, each panel will consist of the four-fold tandem accordion fold that is equal to ⅕ the original width (i.e., W1=⅕ W). This initial fold results in the sheet stock having a tandem series of substantially equally-sized adjoining panels, with accordion folds (running length-wise) being positioned between adjacent panels. Following completion of this initial fold, the sheet stock will have an overall thickness of five plies.

At FIG. 3B-3, and following the re-orientation of the individual sheet stock 31 to a different predetermined second direction (i.e., re-oriented substantially 90 degrees from the first direction), a second fold 33 is then made across the entire width of the sheet stock at a designated location and is at a right angle from the point of origin. This second fold may be an even fold or an uneven fold (i.e., may be folded over to less than all of the adjoining section of the sheet stock). This second fold will result in the sheet stock having a top panel length (L1) and an adjoining bottom panel length (L2).

If the second fold is an even fold, the resulting length will be ½ of the initial length (i.e., L1=L2=½ L). Following completion of this second fold, the sheet stock will have an overall thickness of ten plies. Also, after completion of this second fold, the resulting folded sheet stock will have two ends of orientation, one end being a folded closed-end, and the other end being an open-edge end, not having any fold.

At FIG. 3B-4, a third fold 34 is made across the entire width of the sheet stock at a right angle from the point of origin, the third fold being located at the open-edge end of the folded sheet stock. This third fold is equal to approximately ¼ of the total panel length and will result in the sheet stock now having a resulting top panel length (L1) and a resulting adjoining bottom panel length (L2) (i.e., L1=¼ L and L2=¾ L). Following completion of this third fold, the sheet stock will have an overall thickness of twenty plies for the resulting top panel length, and ten plies for the resulting bottom panel length.

At FIG. 3B-5, a fourth fold 35 is made across the entire width of the sheet stock at a right angle from the point of origin, the fourth fold being located at the section of folded sheet stock that is adjacent to the open-edge end portion of the folded sheet stock. This fourth fold is equal to approximately ⅓ of the total panel length and will result in the sheet stock now having a resulting top panel length (L1) and a resulting adjoining bottom panel length (L2) (i.e., L1=⅓ L and L2=⅔ L). Following completion of this fourth fold, the sheet stock will have an overall thickness of thirty plies for the resulting top panel length, and ten plies for the resulting bottom panel length.

At FIG. 3B-5, following the fourth fold, at a designated location on the resulting bottom panel length, a single glue spot 36 (or glue spots) is made thereon, with a suitable adhesive. If desired, the gluing step may be omitted.

At FIG. 3B-6, a fifth fold 37 is made to complete the outsert. The fifth fold is made across the entire width of the sheet stock at a right angle from the point of origin, the fifth fold being located at the section of folded sheet stock that is next to the adjacent section previously discussed (i.e., the adjacent section being next to the open-edge end portion of the folded sheet stock). This fifth fold is equal to approximately ½ of the total panel length and will result in the sheet stock now having a resulting top panel length (L1) and a resulting adjoining bottom panel length (L2) (i.e., L1=½ L and L2=½ L). This fifth fold is made in a manner whereby the adhesive will maintain the outsert in a more or less fixed and compact relationship with respect to the top and bottom panel lengths of the folded sheet stock. Following completion of this final fold, the outsert will have an overall thickness of forty plies.

FIG. 4A is a perspective view of a universal, nonjamming, multi-ply outsert 50 having multiple folds, which is manufactured from an integral sheet of stock. FIGS. 4B-1 through 4B-7 illustrate the method of forming the outsert 50 depicted in FIG. 4A. Referring to FIGS. 4A and 4B, the method starts with web stock that is fed to an in-line cutter, where the stock is cut into separate individual sheets (or, alternatively, starting with individual sheet stock which is automatically stacked and fed). The size of the individual sheet stock is variable. For example, it has been demonstrated that starting with a commercial grade sheet stock having an overall length (L) of approximately 18 inches, and an overall width (W) of approximately 12 inches, an outsert can be manufactured having a total of eight folds, a sixty-four total ply thickness, and an overall size of approximately 2.25 inches wide, approximately 1.5 inches high, and approximately 0.25 inches thick (depending on the thickness of the individual sheet stock used).

To manufacture the outsert depicted in FIG. 4A, starting at FIG. 4B-1, and with the individual sheet stock 51 traveling in a predetermined first direction, an initial fold 52 is made across the entire length of the sheet stock and is at a right angle from the point of origin (see FIG. 4B-2). This initial fold may be an even fold or an uneven fold (i.e., may be folded over to less than all of the adjoining section of sheet stock). This initial fold results in the sheet stock having a top section (W1) and an adjoining bottom section (W2).

If the initial fold is an even fold, the resulting width will be ½ of the initial width (i.e., W1=W2=½ W). Following completion of this initial fold, the sheet stock will have an overall thickness of two plies.

At FIGS. 4B-3A through 4B-3C, a second fold 53, which consists of a number of substantially parallel folds (consisting of a series of tandem folds comprising a three-fold accordion fold 54(*a*), 54(*b*) and 54(*c*)), is made across the entire length of the sheet stock and is at a right angle from the point of origin. This second fold may be an even fold or an uneven fold (i.e., may be folded over to less than all of the adjoining section of sheet stock).

If the second fold is an even fold, the resulting width will be ¼ of the initial width (i.e., W1=W2=W3=W4=¼ W). This second fold is a three-fold tandem accordion fold, and assuming the second fold has four equal panels, each panel will consist of the three-fold tandem accordion fold that is equal to ¼ the original width (i.e., W=¼ W). This second fold results in the sheet stock having a tandem series of substantially equally-sized adjoining panels, with accordion folds (running length-wise) being positioned between adjacent panels. Following completion of this fold, the sheet stock will have an overall thickness of eight plies.

At FIG. 4B-4, and following the re-orientation of the individual sheet stock 51 to a different predetermined second direction (i.e., re-oriented substantially 90 degrees from the first direction), a third fold 55 is then made across the entire width of the sheet stock at a designated location and is at a right angle from the point of origin. This third fold is an uneven fold (i.e., a short fold); this third fold will result in the sheet stock having a top panel length (L1) having open edges and an adjoining bottom panel length (L2) having no open edges (but having one end with open edges). The third fold will create a top panel having open edges that is equal to ⅜ of the initial length (L1=⅜ L) and an adjoining bottom panel (L2=⅝ L). Following completion of this third fold, the outsert will have an overall thickness of sixteen plies. Also, after completion of this third fold, the resulting folded sheet stock will have two ends of orientation, one end longer than the other end.

Figure 1A:
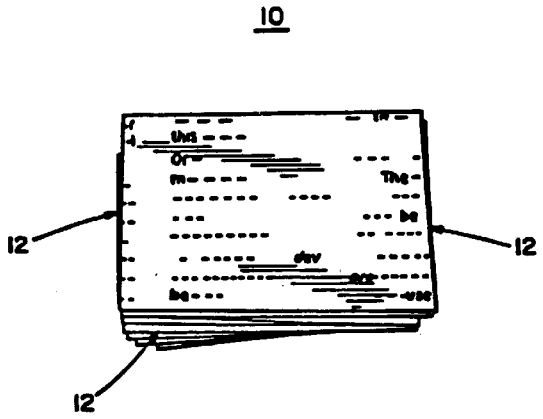
PRIOR ART FIG. 1A
FIG. 1A illustrates an example of an outsert having open edges about its periphery constructed in accordance with the prior art.
Figure 1B:
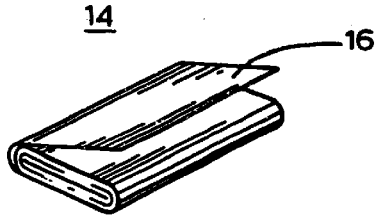
PRIOR ART FIG. 1B
FIG. 1B illustrates a ribbon style outsert constructed in accordance with the prior art.
Figure 5:
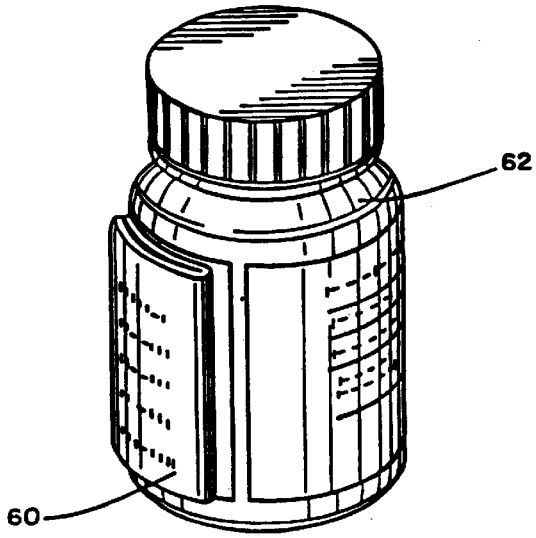
FIGS. 2B-1 through 2B-5 illustrate the method of forming the outsert illustrated in FIG. 2A.

At FIG. 4B-5, a fourth fold 56 is made across the entire width of the sheet stock at a designated location and is at a right angle from the point of origin at a location on the short panel lengths. This fourth fold is an uneven fold (i.e., a short fold) and is located at the shorter top panel end having open-edges of the folded sheet stock. This fourth fold will result in the sheet stock having a top panel length (L1) having no open peripheral edges and an adjoining bottom panel length (L2) having no open peripheral edges. The fourth fold will create a top panel that is equal to ⅖ of the initial length (L1=⅖ L) and an adjoining bottom panel that is equal to ⅗ of the initial length (L2=⅗ L). Following completion of this fourth fold, the outsert will have an overall thickness of twenty-four plies (and sixteen plies at the other portion of the outsert). Also, after completion of this fourth fold, the resulting folded sheet stock will have two ends of orientation, each end having no open edges.

At FIG. 4B-6, a fifth fold 57 is made across the entire width of the sheet stock at a right angle from the point of origin, the fifth fold being located at the section of folded sheet stock that is adjacent to the open-edge end portion of the folded sheet stock on the panel having the longer panel length. This fifth fold is equal to approximately ⅓ of the total panel length and will result in the outsert now having a resulting top panel length (L1) and a resulting adjoining bottom panel length (L2) (i.e., L1=⅓ L and L2=⅔ L). Each of the resulting adjoining bottom and top panels will now have closed ends (i.e., no open edges). Following completion of this fifth fold, the sheet stock will have an overall thickness of forty plies for the resulting bottom panel length, and twenty-four plies for the resulting top panel length.

At FIG. 4B-6, following the fifth fold, at a designated location on the resulting top panel length, a single glue spot 58 (or glue spots) is made thereon, with a suitable adhesive. If desired, the gluing step may be omitted.

At FIG. 4B-7, a sixth fold 59 is made to complete the outsert. The sixth fold is made across the entire width of the sheet stock at a right angle from the point of origin. This sixth fold is equal to approximately ½ of the total panel length and will result in the sheet stock now having a resulting top panel length (L1) and a resulting adjoining bottom panel length (L2) (i.e., L1=½ L and L2=½ L). This sixth fold is made and folded over the second end of the resulting panel length and is made in a manner whereby the adhesive will maintain the outsert in a more or less fixed and compact relationship with respect to the top and bottom panel lengths of the folded sheet stock. Following completion of this final fold, the outsert will have an overall thickness of sixty-four plies.

FIG. 5 is a perspective view of an outsert 60 applied to the outside of a container 62 for a pharmaceutical product.

Figure 6A:
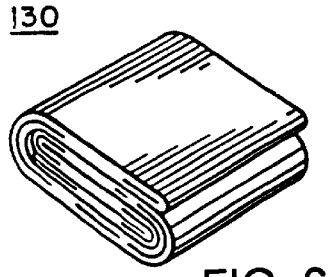
FIG. 6A is a perspective view of a fourth embodiment of an outsert.
Figures 1, 6B:
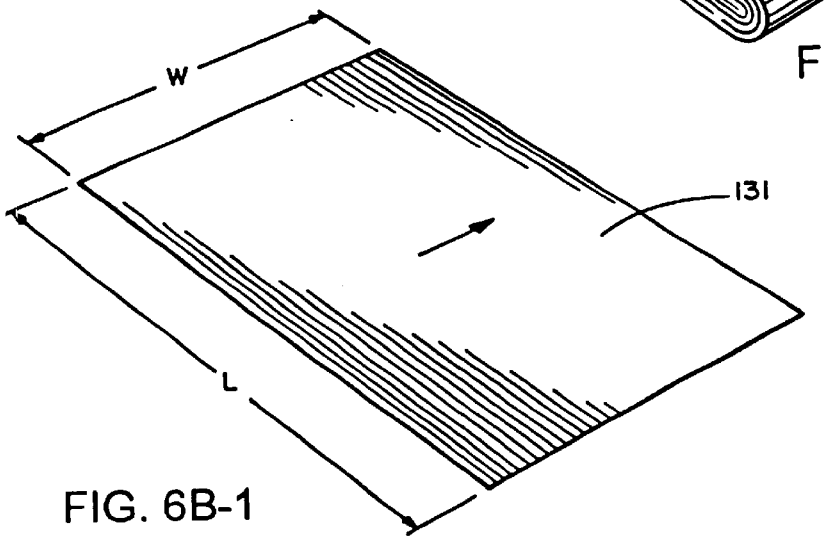
Figures 3, 6B:
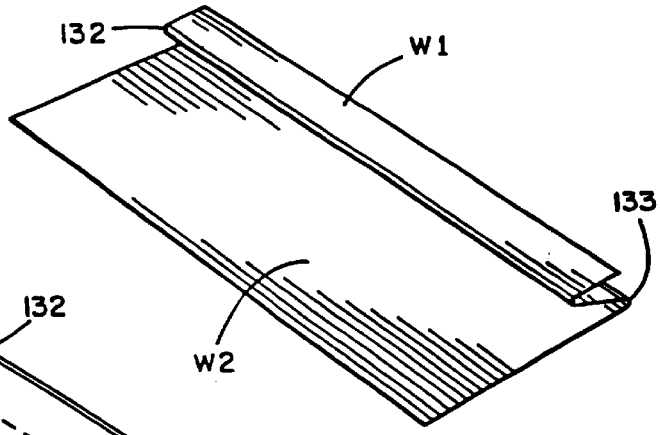
Figures 2, 6B:
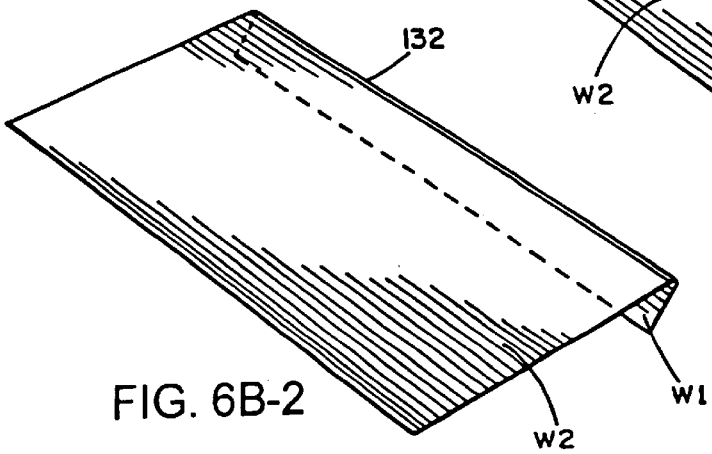
Figures 4, 6B:
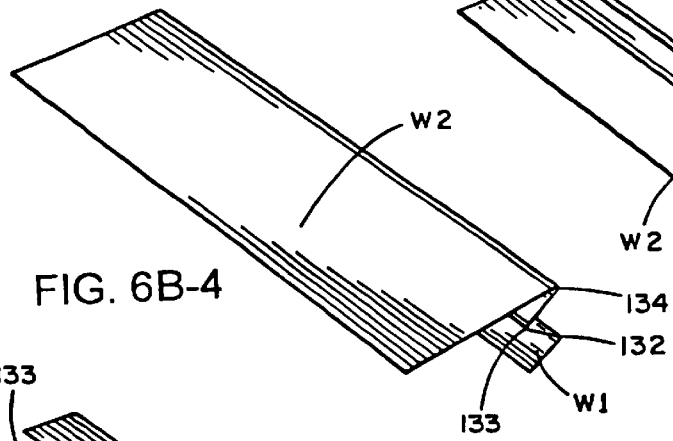
Figures 5, 6B:
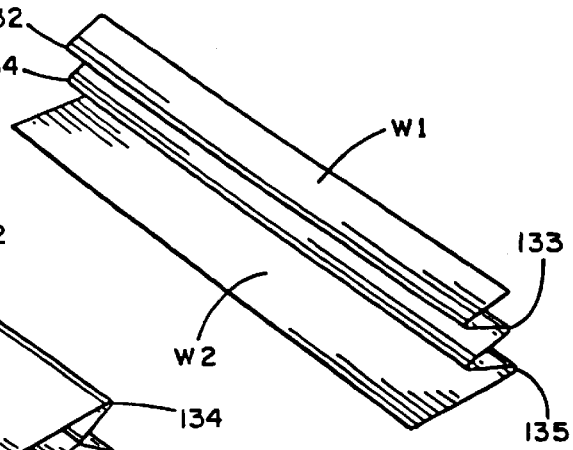
Figures 6, 6B:
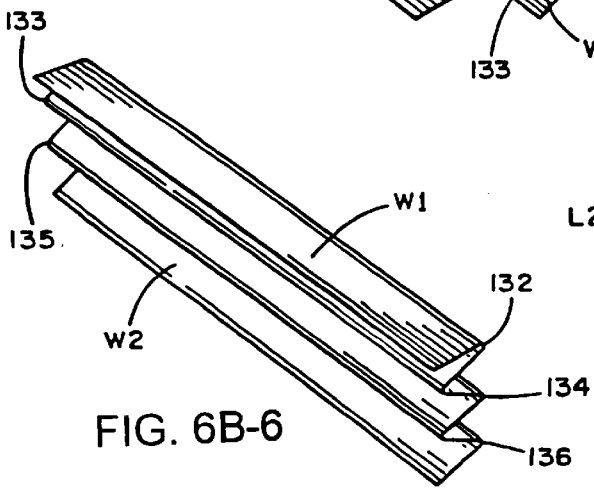

FIG. 6A is a perspective view of a universal, nonjamming, multi-ply, multi-fold, reduced-size outsert 130 having increased copyspace, which is manufactured from an integral sheet of stock. FIGS. 6B-1 through 6B-10 illustrate the method of forming the outsert 130 depicted in FIG. 6A. Referring to FIGS. 6A and 6B, the method starts with web stock that is directly fed to an in-line cutter, where the stock is cut into separate individual sheets (or, alternatively, starting with individual sheet stock which is automatically stacked and fed). The size and weight of the individual sheet stock are variable. For example, it has been demonstrated that starting with a commercial grade sheet stock having an overall length (L) of approximately 11 inches, and an overall width (W) of approximately 6.625 inches, an outsert can be manufactured having nine folds, a total thickness of sixty plies, and an overall size of approximately 1.125 inches long, approximately 1.125 inches wide, and approximately 0.188 inches thick (depending on the thickness of the sheet stock utilized).

To manufacture the outsert depicted in FIG. 6A, starting at FIG. 6B-1, and with the individual sheet stock 131 traveling in a predetermined first direction, an initial accordion fold is made across the entire length of the sheet stock and is at a right angle from the point of origin (see FIG. 6B-2). This initial fold consists of a number of substantially parallel folds (consisting of a series of tandem folds 132, 133, 134, 135 and 136, comprising a five-fold accordion fold), and is made across the entire length of the sheet stock and is at a right angle from the point of origin (see FIGS. 6B-2 through 6B-6).

This initial fold is a five-fold tandem accordion fold and results in the sheet stock having a tandem series of substantially equally-sized adjoining panels, with accordion folds (running length-wise) being positioned between adjacent panels. The initial fold may be an even fold or an uneven fold (i.e., may be folded over to less than all of the adjoining section of sheet stock). Assuming the initial fold has equal panels (e.g., the initial fold is an even fold), each panel will consist of the five-fold tandem accordion fold that is equal to ⅙ the original width (i.e., W1=⅙ W) and the resulting width of each panel will be ⅙ of the initial width (i.e., W1=W2=W3=W4=W5=W6=⅙ W). Following completion of this initial fold, the sheet stock will have an overall thickness of six plies.

Figures 3, 3B, 4, 5, 6:
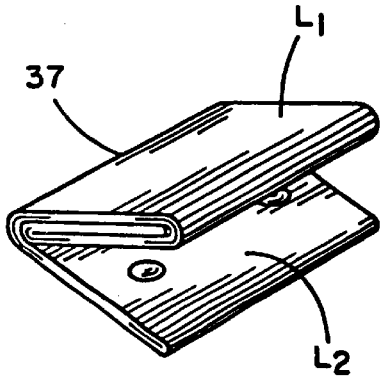
Figures 6, 6B, 7, 8:
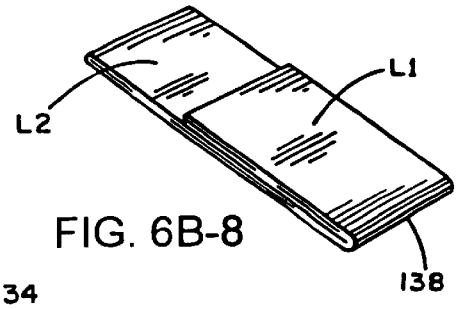
Figures 6, 6B, 7:
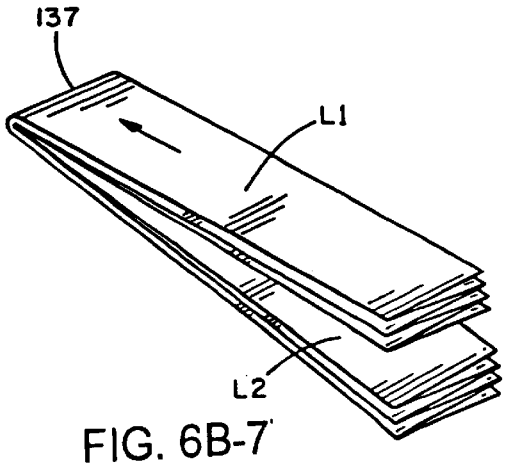
Figures 6, 6B, 7, 8, 9:
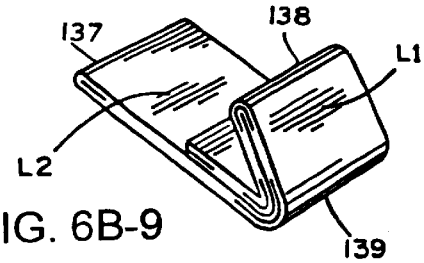
Figures 6, 6B, 7, 8, 9, 10:
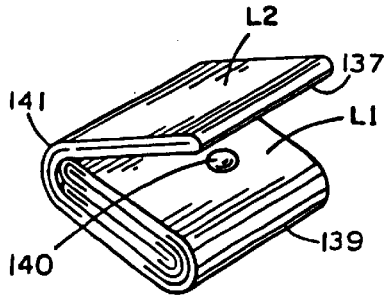

At FIG. 6B-7, and following the re-orientation of the individual sheet stock 131 to a different predetermined second direction (i.e., re-oriented substantially 90 degrees from the first direction), a sixth fold 137 is then made across the entire width of the sheet stock at a designated location and is at a right angle from the point of origin. This sixth fold may be an even fold or an uneven fold (i.e., may be folded over to less than all of the adjoining section of the sheet stock). This sixth fold will result in the sheet stock having a top panel length (L1) and an adjoining bottom panel length (L2).

If the sixth fold is an even fold, the resulting panel length will be ½ of the initial length (i.e., L1=L2=½ L). Following completion of this sixth fold, the sheet stock will have an overall maximum thickness of twelve plies. Also, after completion of this sixth fold, the resulting folded sheet stock will have two ends of orientation, one end being a folded closed-end, and the other end being an open-edge end, not having any fold.

At FIG. 6B-8, a seventh fold 138 is made across the entire width of the sheet stock at a right angle from the point of origin, the seventh fold being located at the open-edge end of the folded sheet stock. This seventh fold is equal to approximately ⅖ of the total panel length and will result in the sheet stock now having a resulting top panel length (L1) and a resulting adjoining bottom panel length (L2) (i.e., L1=⅖ L and L2=⅗ L). Following completion of this seventh fold, the sheet stock will have an overall maximum thickness of twenty-four plies (e.g., resulting in twelve ply thickness at one end of the outsert and resulting in twenty-four ply thickness at the opposite end of the outsert).

At FIG. 6B-9, an eighth fold 139 is made across the entire width of the sheet stock at a right angle from the point of origin. This eighth fold is equal to approximately ⅓ of the total panel length and will result in the sheet stock now having a resulting top panel length (L1) and a resulting adjoining bottom panel length (L2) (i.e., L1=⅓ L and L2=⅔ L). Following completion of this eighth fold, the sheet stock will have an overall maximum thickness of forty-eight plies (e.g., resulting in twelve ply thickness at one end of the outsert and resulting in forty-eight ply thickness at the opposite end of the outsert).

At FIG. 6B-10, following the eighth fold, at a designated location on the outsert, a single glue spot 140 (or glue spots) is made thereon, with a suitable adhesive. If desired, the gluing step may be omitted.

At FIG. 6B-10, a ninth fold 141 is made to complete the outsert. The ninth fold is made across the entire width of the sheet stock at a right angle from the point of origin. This ninth fold is equal to approximately ½ of the total panel length and will result in the sheet stock now having a resulting top panel length (L1) and a resulting adjoining bottom panel length (L2) (i.e., L1=½ L and L2=½ L). This ninth fold is made in a manner whereby the adhesive will maintain the outsert in a more or less fixed and compact relationship with respect to the top and bottom panel lengths of the folded sheet stock. Following completion of this final fold, the outsert will have an overall thickness of sixty plies.

The method of forming the outsert 130 depicted in FIG. 6A may be modified slightly to form an outsert having a slightly different structure. In particular, the method of forming the outsert 130 may be modified in the following respects: 1) the modified method utilizes a sheet of stock having an overall length (L) of approximately 18 inches and an overall width (W) of approximately 10 inches; 2) in the modified method, an accordion fold having eight tandem folds (to produce nine equal-length panels) is initially made (instead of an accordion fold with five tandem folds as shown in FIG. 6B-6); 3) in the modified method, the accordion fold is made in the direction parallel to the width of the sheet stock (instead of parallel to the length of the sheet stock as shown in FIGS. 6B-1 through 6B-6); and 4) two spots of glue may be used (instead of the single spot 140 shown in FIG. 6B-10). This modified method will form an outsert having twelve folds, a total thickness of ninety plies, and an overall size of approximately 2 inches long, approximately 1 inch wide, and approximately 0.25 inches thick (depending on the thickness of the sheet stock used).

Figure 7A:
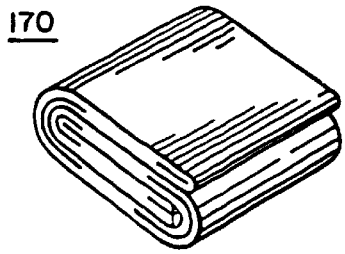
FIG. 7A is a perspective view of a fifth embodiment of an outsert.
Figures 1, 7B:
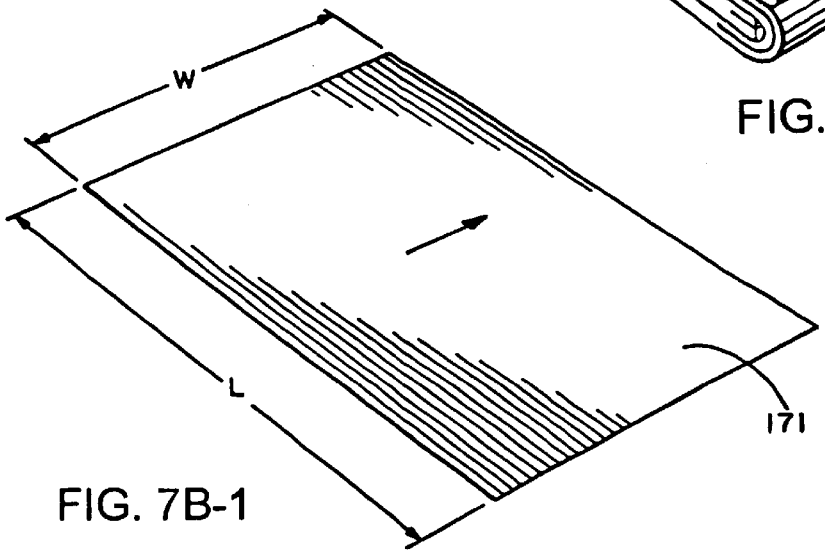
Figures 2, 7B:
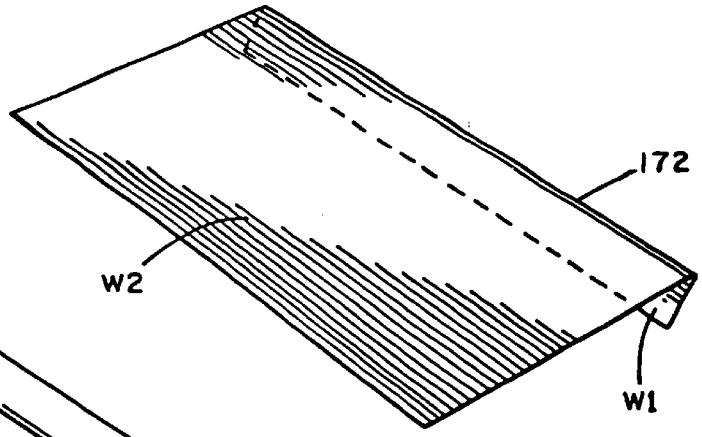
Figures 3, 7B:
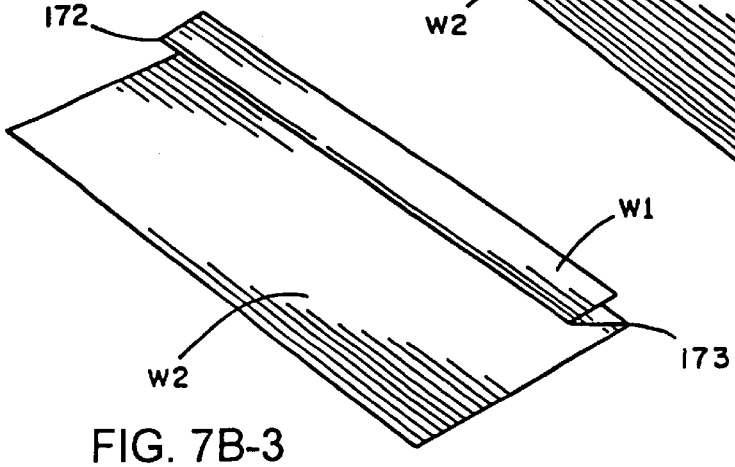
Figures 4, 7B:
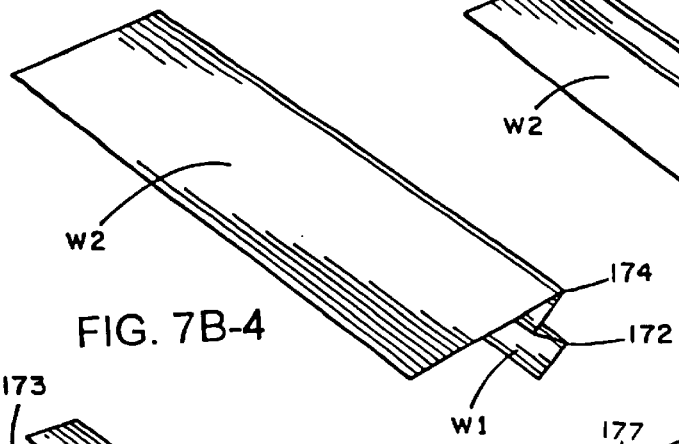
Figures 5, 7B:
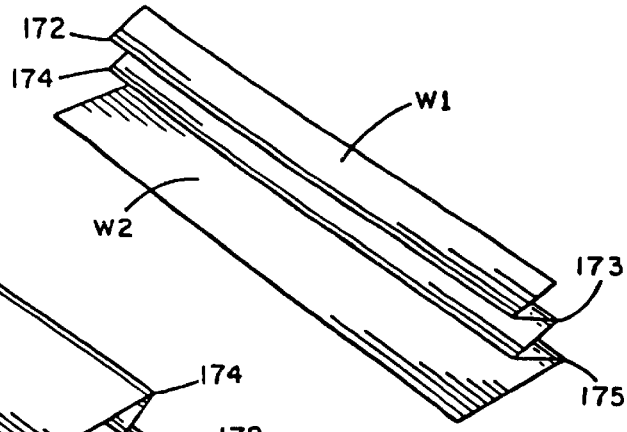
Figures 6, 7B:
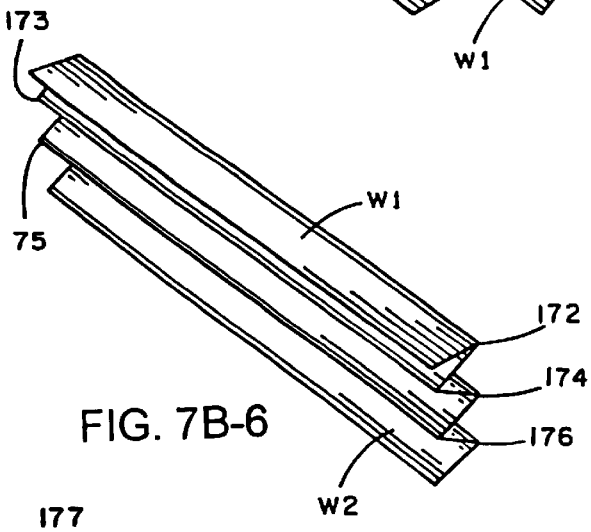
Figures 7, 7B, 8:
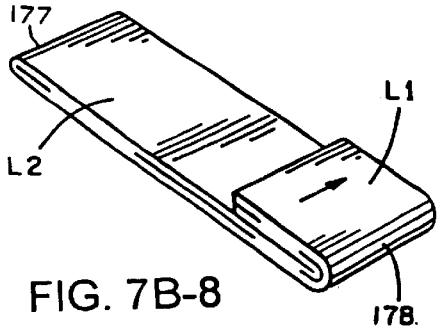
Figures 7, 7B, 8, 9:
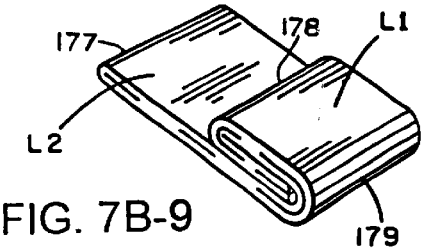
Figures 7, 7B:
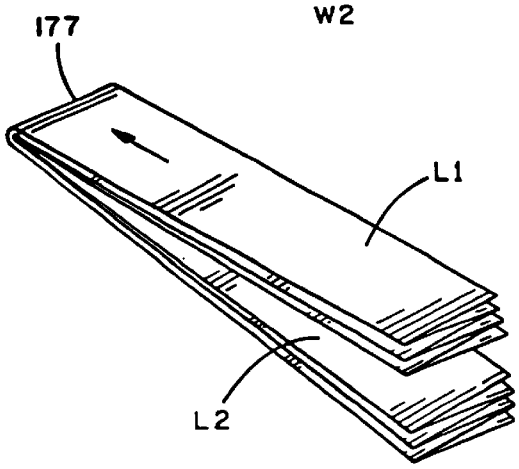
Figures 7, 7B, 8, 9, 10:
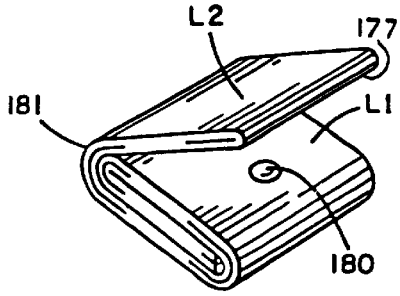

FIG. 7A is a perspective view of a universal, nonjamming, multi-ply, multi-fold, reduced-size outsert 170 having increased copyspace, which is manufactured from an integral sheet of stock. FIGS. 7B-1 through 7B-10 illustrate the method of forming the outsert 170 depicted in FIG. 7A. Referring to FIGS. 7A and 7B, the method starts with web stock that is fed to an in-line cutter, where the stock is cut into separate individual sheets (or, alternatively, starting with individual sheet stock which is automatically stacked and fed). The size and weight of the individual sheet stock are variable. For example, it has been demonstrated that starting with a commercial grade sheet stock having an overall length (L) of approximately 10 inches, and an overall width (W) of approximately 7.5 inches, an outsert can be manufactured having a total of nine folds, a total thickness of forty-eight plies, and an overall size of approximately 1.375 inches long, approximately 1.375 inches wide, and approximately 0.188 inches thick (depending on the thickness of the individual sheet stock utilized).

To manufacture the outsert depicted in FIG. 7A, starting at FIG. 7B-1, and with the individual sheet stock 171 traveling in a predetermined first direction, an initial accordion fold is made across the entire length of the sheet stock and is at a right angle from the point of origin (see FIG. 7B-2)). This initial fold consists of a number of substantially parallel folds (consisting of a series of tandem folds 172, 173, 174, 175 and 176, comprising a five-fold accordion fold), and is made across the entire length of the sheet stock and is at a right angle from the point of origin (see FIGS. 7B-2 through 7B-6).

This initial fold is a five-fold tandem accordion fold and results in the sheet stock having a tandem series of substantially equally-sized adjoining panels, with accordion folds (running length-wise) being positioned between adjacent panels. The initial fold may be an even fold or an uneven fold (i.e., may be folded over to less than all of the adjoining section of sheet stock). Assuming the initial fold has equal panels (e.g., the initial fold is an even fold), each panel will consist of the five-fold tandem accordion fold that is equal to ⅙ the original width (i.e., W1=⅙ W) and the resulting width of each panel will be ⅙ of the initial width (i.e., W1=W2=W3=W4=W5=W6=⅙ W). Following completion of this initial fold, the sheet stock will have an overall thickness of six plies.

At FIG. 7B-7, and following the re-orientation of the individual sheet stock 171 to a different predetermined second direction (i.e., re-oriented substantially 90 degrees from the first direction), a sixth fold 177 is then made across the entire width of the sheet stock at a designated location and is at a right angle from the point of origin. This sixth fold may be an even fold or an uneven fold (i.e., may be folded over to less than all of the adjoining section of the sheet stock). This sixth fold will result in the sheet stock having a top panel length (L1) and an adjoining bottom panel length (L2).

If the sixth fold is an even fold, the resulting panel length will be ½ of the initial length (i.e., L1=L2=½ L). Following completion of this sixth fold, the sheet stock will have an overall maximum thickness of twelve plies. Also, after completion of this sixth fold, the resulting folded sheet stock will have two ends of orientation, one end being a folded closed end, and the other end being an open-edge end, not having any fold.

Figure 8:
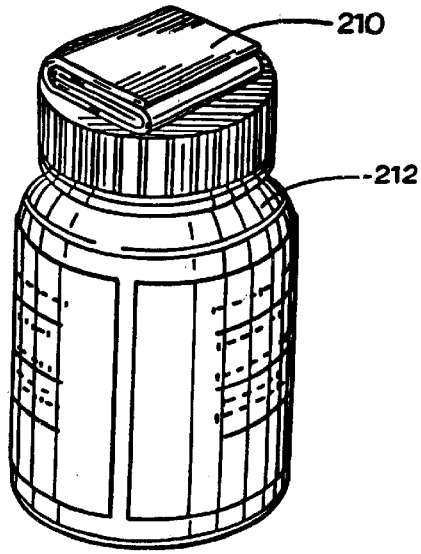

At FIG. 7B-8, a seventh fold 178 is made across the entire width of the sheet stock at a right angle from the point of origin, the seventh fold being located at the open-edge end of the folded sheet stock. This seventh fold is equal to approximately ⅕ of the total panel length and will result in the sheet stock now having a resulting top panel length (L1) and a resulting adjoining bottom panel length (L2) (i.e., L1=⅕ L and L2=⅘ L). Following completion of this seventh fold, the sheet stock will have an overall maximum thickness of twenty-four plies (e.g., resulting in twelve ply thickness at one end of the outsert and resulting in twenty-four ply thickness at the opposite end of the outsert).

At FIG. 7B-9, an eighth fold 179 is made across the entire width of the sheet stock at a right angle from the point of origin. This eighth fold is equal to approximately ⅓ of the total panel length and will result in the sheet stock now having a resulting top panel length (L1) and a resulting adjoining bottom panel length (L2) (i.e., L1=⅓ L and L2=⅔ L). Following completion of this eighth fold, the sheet stock will have an overall maximum thickness of thirty-six plies (e.g., resulting in twelve ply thickness at one end of the outsert and resulting in thirty-six ply thickness at the opposite end of the outsert).

At FIG. 7B-10, following the eighth fold, at a designated location on the outsert, a single glue spot 180 (or glue spots)

is made thereon, with a suitable adhesive. If desired, the gluing step may be omitted.

At FIG. 7B-10, a ninth fold 181 is made to complete the outsert. The ninth fold is made across the entire width of the sheet stock at a right angle from the point of origin. This ninth fold is equal to approximately ½ of the total panel length and will result in the sheet stock now having a resulting top panel length (L1) and a resulting adjoining bottom panel length (L2) (i.e., L1=½ L and L2=½ L). This ninth fold is made in a manner whereby the adhesive will maintain the outsert in a more or less fixed and compact relationship with respect to the top and bottom panels lengths of the folded sheet stock. Following completion of this final fold, the outsert will have an overall thickness of forty-eight plies.

The method of forming the outsert 170 depicted in FIG. 7A may be modified slightly to form an outsert having a slightly different structure. In particular, the method of forming the outsert 170 may be modified in the following respects: 1) the modified method utilizes a sheet of stock having an overall length (L) of approximately 24 inches and an overall width (W) of approximately 10 inches; 2) in the modified method, an accordion fold having seven tandem folds (to produce eight equal-length panels) is initially made (instead of an accordion fold with five tandem folds as shown in FIG. 7B-6); 3) in the modified method, the accordion fold is made in the direction parallel to the width of the sheet stock (instead of parallel to the length of the sheet stock as shown in FIGS. 7B-1 through 7B-6); and 4) two spots of glue may be used (instead of the single spot 180 shown in FIG. 7B-10). This modified method will form an outsert having eleven folds, a total thickness of sixty-four plies, and an overall size of approximately 1.25 inches long, approximately 3 inches wide, and approximately 0.188 inches thick (depending on the thickness of the sheet stock used).

FIG. 8 is a perspective view of an outsert 210 applied to the top of a container 212 for a pharmaceutical product.

Each of the outserts described above may optionally be imperceptibly scored at various positions intrinsic to the outsert (indicating that the outsert is folded in a particular direction along the score line), to assist in the folding of the outsert, and, accordingly, each score line is part and parcel of each outsert.

The methods of folding described above in connection with FIGS. 2B-4B and 6B-7B eliminate all unfolded exterior edges which lie in a direction parallel to the final fold direction, resulting in outserts having a more compact three-dimensional physical envelope. Inasmuch as the outserts depicted in FIGS. 2A-4A and 6A-7A are manufactured from a single sheet of stock, the outserts do not require any trimming step to be performed to achieve a certain size. The final size of the outserts is achieved by selecting a particular respective size of initial sheet stock to be utilized.

Although specific dimensions have been disclosed herein for the sheet stock from which outserts are formed and for the final outserts themselves, those particular dimensions are not considered important to the invention, and outserts having different dimensions may be formed from sheet stock having different dimensions.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A method of folding a sheet having printed information thereon to form an outsert for providing information to the user of a product, said sheet having a thickness and said outsert having a number of sheet portions, said method comprising:

(a) folding said sheet by making a first fold in said sheet, said first fold being parallel to a first direction;

(b) folding said sheet by making a second fold in said sheet, said second fold being parallel to said first direction;

(c) folding said sheet by making a third fold in said sheet, said third fold being parallel to said first direction;

(d) folding said sheet by making at least one additional fold in said sheet, said at least one additional fold being parallel to said first direction and being made to form a first folded article having a first end and a second end, each of said first and second ends of said first folded article having unfolded exterior sheet edges which lie in a direction perpendicular to said first direction;

(e) after completion of (a) through (d), folding said first folded article by making a first fold in said first folded article in a second direction perpendicular to said first direction to form a second folded article, said second folded article having a first end and a second end, said first end of said second folded article having no unfolded exterior sheet edges;

(f) folding said second folded article by making a second fold in said second direction to form a third folded article having a first end and a second end, said second fold being made so that said second end of said second folded article is disposed between said first and second ends of said third folded article;

(g) folding said third folded article by making a third fold in said second direction to form a fourth folded article, said fourth folded article having a sheet portion;

(h) depositing an adhesive on said sheet portion of said fourth folded article; and (i) folding said fourth folded article by making a fourth fold in a direction parallel to said second direction to form said outsert, said fourth fold being made so that said second end of said second folded article is covered by one of said sheet portions of said outsert and so that there are no unfolded exterior sheet edges which lie in a direction parallel to said second direction, said thickness of said sheet being such that, when said folds in said first and second directions are made, said folds will cause said outsert to have a thickness of 0.25 inches or greater.

2. A method as defined in claim 1 wherein said thickness of said sheet is such that, when said folds in said first and second directions are made, said folds will cause said outsert to have a thickness of greater than 0.25 inches.

3. An outsert folded in accordance with the method defined in claim 1.

4. An outsert folded in accordance with the method defined in claim 2.

5. A method of folding a sheet having printed information thereon to form an outsert for providing information to the user of a product, said sheet having a thickness and said outsert having a number of sheet portions, said method comprising:

(a) folding said sheet by making a first fold in said sheet, said first fold being parallel to a first direction;

(b) folding said sheet by making a second fold in said sheet, said second fold being parallel to said first direction;

(c) folding said sheet by making at least one additional fold in said sheet, said at least one additional fold being parallel to said first direction and being made to form a first folded article having a first end and a second end, each of said first and second ends of said first folded article having unfolded exterior sheet edges which lie in a direction perpendicular to said first direction;

(d) after completion of (a) through (c), folding said first folded article by making a first fold in said first folded article in a second direction perpendicular to said first direction to form a second folded article, said second folded article having a first end and a second end, said first end of said second folded article having no unfolded exterior sheet edges;

(e) making at least one additional fold in a direction parallel to said second direction to form a third folded article, said third folded article having a sheet portion;

(f) depositing an adhesive on said sheet portion of said third folded article; and (g) folding said third folded article by making a final fold in a direction parallel to said second direction to form said outsert, said final fold being made so that said second end of said second folded article is covered by one of said sheet portions of said outsert and so that there are no unfolded exterior sheet edges which lie in a direction parallel to said second direction, said thickness of said sheet being such that when said folds in said first and second directions are made, said folds will cause said outsert to have a thickness of 0.25 inches or greater.

6. A method as defined in claim 5 wherein said thickness of said sheet is such that when said folds in said first and second directions are made, said folds will cause said outsert to have a thickness of greater than 0.25 inches.

7. An outsert folded in accordance with the method defined in claim 5.

8. An outsert folded in accordance with the method defined in claim 6.

9. A method of producing a folded item having printed information thereon to provide information to the user of a product, said folded item having a plurality of sheet portions and being formed from a sheet having a thickness, said method comprising:

(a) forming a first article having a first end, a second end, a length along a first direction, and a width along a second direction perpendicular to said first direction, said first article having a plurality of first elongate sheet portions and a plurality of second elongate sheet portions, each of said first elongate sheet portions having a first end and a second end, and each of said second elongate sheet portions having a first end and a second end, each of said first ends of said first elongate sheet portions being joined to a respective one of said first ends of said second elongate sheet portions at a respective fold coinciding with said first end of said first article so that said first end of said first article has no exterior unfolded sheet edges, each of said respective folds being parallel to said second direction;

(b) folding said first article by making a first transverse fold in said first article to form a second article, said first transverse fold being parallel to said second direction and being made so that said second end of said first article is disposed between said first end of said first article and said first transverse fold;

(c) depositing an adhesive on a portion of said second article; and (d) folding said second article by making a second transverse fold in said second article to form said folded item, said second transverse fold being parallel to said second direction so that said folded item has no exterior unfolded sheet edges which lie in a direction parallel to said second direction, said thickness of said sheet being such that when said folds in said first and second directions are made, said folds will cause said folded item to have a thickness of 0.25 inches or greater.

10. A method as defined in claim 9 wherein said thickness of said sheet is such that when said folds in said first and second directions are made, said folds will cause said folded item to have a thickness of greater than 0.25 inches.

11. An item formed in accordance with the method defined in claim 9.

12. An item formed in accordance with the method defined in claim 10.

* * * * *